US008402584B2

(12) United States Patent
Westermark et al.

(10) Patent No.: US 8,402,584 B2
(45) Date of Patent: Mar. 26, 2013

(54) LENGTH CHANGEABLE SHIP RAMP

(75) Inventors: Henrik Westermark, Stenungsund (SE); Hans Salén, Brännö (SE); Renée Salén, legal representative, Brännö (SE)

(73) Assignee: TTS Marine AB, Gothenburg (SE)

( * ) Notice: Subject to any disclaimer, the term of this patent is extended or adjusted under 35 U.S.C. 154(b) by 0 days.

(21) Appl. No.: 13/386,336

(22) PCT Filed: Jul. 20, 2010

(86) PCT No.: PCT/SE2010/050863

§ 371 (c)(1),
(2), (4) Date: Apr. 13, 2012

(87) PCT Pub. No.: WO2011/014114

PCT Pub. Date: Feb. 3, 2011

(65) Prior Publication Data

US 2012/0204363 A1 Aug. 16, 2012

(30) Foreign Application Priority Data

Jul. 28, 2009 (SE) ..... 0950568

(51) Int. Cl.
*B64F 1/30* (2006.01)

(52) U.S. Cl. ..... 14/71.3; 114/362

(58) Field of Classification Search ..... 14/71.3, 14/71.5; 114/362.17, 362
See application file for complete search history.

(56) References Cited

U.S. PATENT DOCUMENTS

| | | | | | |
|---|---|---|---|---|---|
| 2,478,177 | A | * | 8/1949 | Beutel et al. | 14/71.1 |
| 2,527,653 | A | * | 10/1950 | Pierce | 14/71.1 |
| 2,875,457 | A | * | 3/1959 | Read et al. | 14/71.5 |
| 3,483,838 | A | | 12/1969 | Rath | |
| 3,879,784 | A | | 4/1975 | Kummerman | |
| 4,011,615 | A | * | 3/1977 | Maxson et al. | 14/71.1 |
| 4,162,551 | A | * | 7/1979 | Serrano | 14/69.5 |
| 4,169,296 | A | * | 10/1979 | Wipkink et al. | 14/71.1 |
| 4,366,591 | A | | 1/1983 | Zimmerman | |
| 4,473,916 | A | | 10/1984 | Connold | |

(Continued)

FOREIGN PATENT DOCUMENTS

| | | | |
|---|---|---|---|
| CH | 685552 | A5 | 8/1995 |
| FR | 1394747 | A | 3/1965 |

(Continued)

OTHER PUBLICATIONS

Swedish Patent Office, Int'l Search Rpt in PCT/SE2010/050863, Oct. 29, 2010.

(Continued)

*Primary Examiner* — Gary S Hartmann
(74) *Attorney, Agent, or Firm* — Potomac Patent Group PLLC

(57) ABSTRACT

The invention relates to a device (1) for a length-changeable ship ramp (2). According to the invention, a part (3) of a telescope (4) forms a driveway surface on the ramp. Furthermore, a device (50) for a ship ramp (2), which has turntables (51, 51A, 51B) between ramp parts (10, 11, 12), has means for locking the turntables of the telescopic ramp parts in order of priority.

12 Claims, 18 Drawing Sheets

U.S. PATENT DOCUMENTS

| | | | | |
|---|---|---|---|---|
| 4,551,877 | A | 11/1985 | Alten | |
| 4,590,634 | A * | 5/1986 | Williams | 14/71.1 |
| 6,923,140 | B1 * | 8/2005 | Cook | 114/362 |
| 6,955,134 | B2 * | 10/2005 | Prins | 114/230.17 |
| 2003/0041792 | A1 | 3/2003 | Besenzoni | |

FOREIGN PATENT DOCUMENTS

| | | | |
|---|---|---|---|
| FR | 2732321 | A1 | 10/1996 |
| GB | 1331741 | A | 9/1973 |
| WO | 02/20343 | A1 | 3/2002 |
| WO | 2008/153498 | A1 | 12/2008 |

OTHER PUBLICATIONS

Swedish Patent Office, Int'l Prelim Rpt on Patentability in PCT/SE2010/050863, Nov. 2, 2011.

* cited by examiner

LENGTH CHANGEABLE SHIP RAMP

BACKGROUND

The present invention relates to a device for a length-changeable ship ramp that is hoistably pivotably mounted at the end thereof connected to the ship via a pivot joint between a lowered loading and unloading position and a raised stowing position.

Known ship ramps make so that transitions are formed, so-called flap transitions between the ramp parts at an angle of about 4-5° bendings. Accordingly, the upper driveway of such ramps is not always entirely smooth. In addition to unpleasantness of driving across such bendings, they cause, among other things, also undesired noise.

Also undesired turning motions of the ramp are created, which in known ramps makes the loading and unloading, respectively, of ships more difficult.

The ship ramp previously known by GB 1331741 A resembles most a usual telescopic ramp that is found, e.g., on skerry cruisers, e.g. the Waxholm boats, and that is dragged out and in between the ship and dock when desired. Undesired irregularities are then formed at the ends of said ramp. According to the embodiment shown in FIGS. 13-17, an internal ramp part (32) is intended to be hoistable between two cargo decks (30, 31), while an outer curved ramp part (35) is projectable from said inner undisplaceable ramp part (32). In the "telescoping position", one drives either on the inner ramp part (32) or on the outer ramp part (35). This is easy to understand when looking at the construction of the outer ramp part (35), the character of which is clearly shown in the drawings in FIGS. 11 and 12. Accordingly, it is about bars (28) that rest on transverse carriers (27) at the underside of the ramp. With this known ramp construction, no displacement occurs between the ramp parts so that these overlap each other laterally. This can clearly be understood from FIGS. 5 and 6 in said patent specification.

Said known construction may rather be called a "link span" and not a telescopic ramp. In addition, the known ramp is not mounted to be pivotable around a horizontal pivot at the stern or stem of the ship into a vertical position.

SUMMARY

The main object of the present invention is therefore primarily to solve, among others, the problems mentioned above by reliable and efficiently working means.

Said object is achieved by means of a device according to the present invention that essentially is characterized in that a part of a telescope, which is formed and arranged to be formed of telescoping section girders extending in the length extension of the ramp parts, forms a driveway surface on the upwardly facing respective upperside and upper flange of said section girders of the ramp formed thereby.

The present invention also relates to a device for a ship ramp that is hoistably pivotably mounted at the end thereof connected to the ship via a pivot joint between a lowered loading and unloading position and a raised stowing position, and that has turntables between ramp parts adjustable at a desired turning angle in relation to each other.

Known ship ramps do not allow lateral turning of several interconnected ramp parts as well as locking of only certain ones of the same according to a particular configuration, whereby safe driving on the same in all occasions is possible.

A further main object of the present invention is therefore also to solve, among others, the problems mentioned above by reliable and efficiently working means and by a telescopic ramp.

Said further object is achieved by means of a device according to the present invention that essentially is characterized in that at least two lockable turntables are arranged at said ramp, said lockable turntables being preferably arranged lockable in any order of priority, as well as that the ramp is telescopic and formed of ramp parts each of which is formed and arranged to be formed of telescoping section girders extending in the length extension of the ramp parts, and the driveway surface of which is formed of the upwardly facing respective upperside and upper flange of said section girders of the ramp formed thereby.

BRIEF DESCRIPTION OF THE DRAWINGS

The invention is described in the following, reference being made to the accompanying drawings, in which.

DETAILED DESCRIPTION

Figure 1:
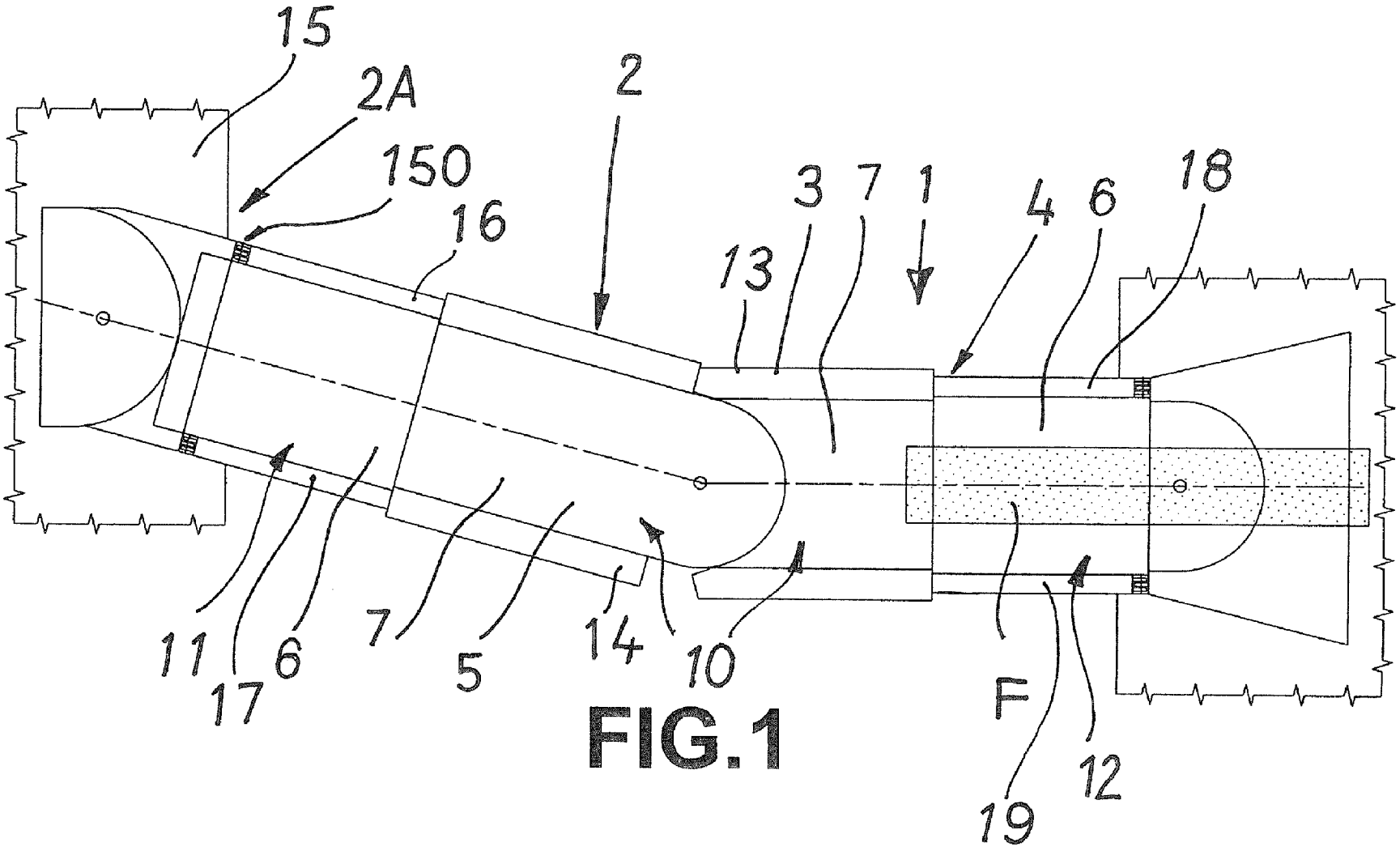
FIG. 1 shows an explanatory sketch of a ramp having turntables with a shown vehicle thereon.
Figure 2:
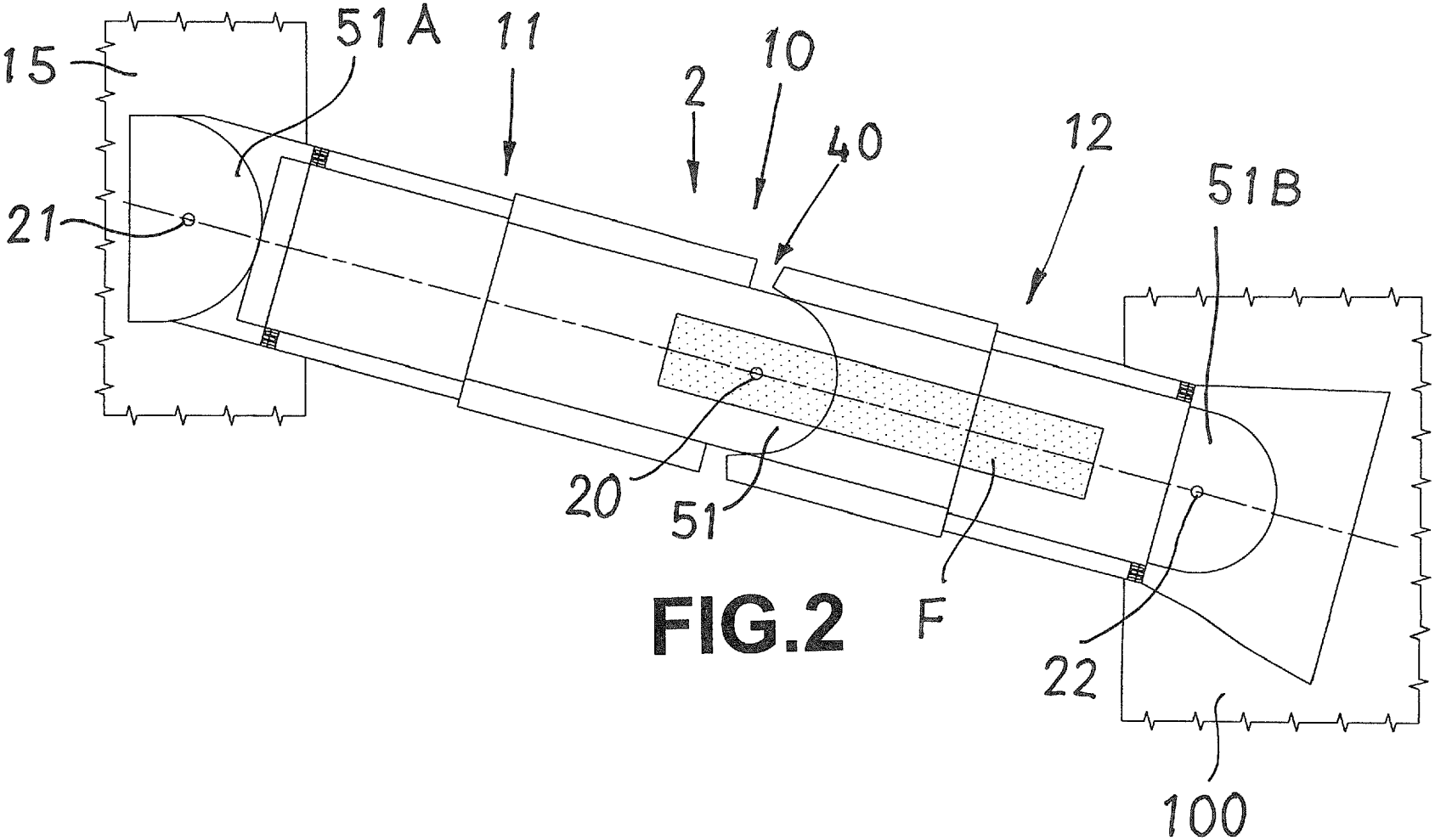
FIGS. 2-4 show the ramp and the turntables thereof adjustable as a vehicle is driven thereon.
Figure 3:
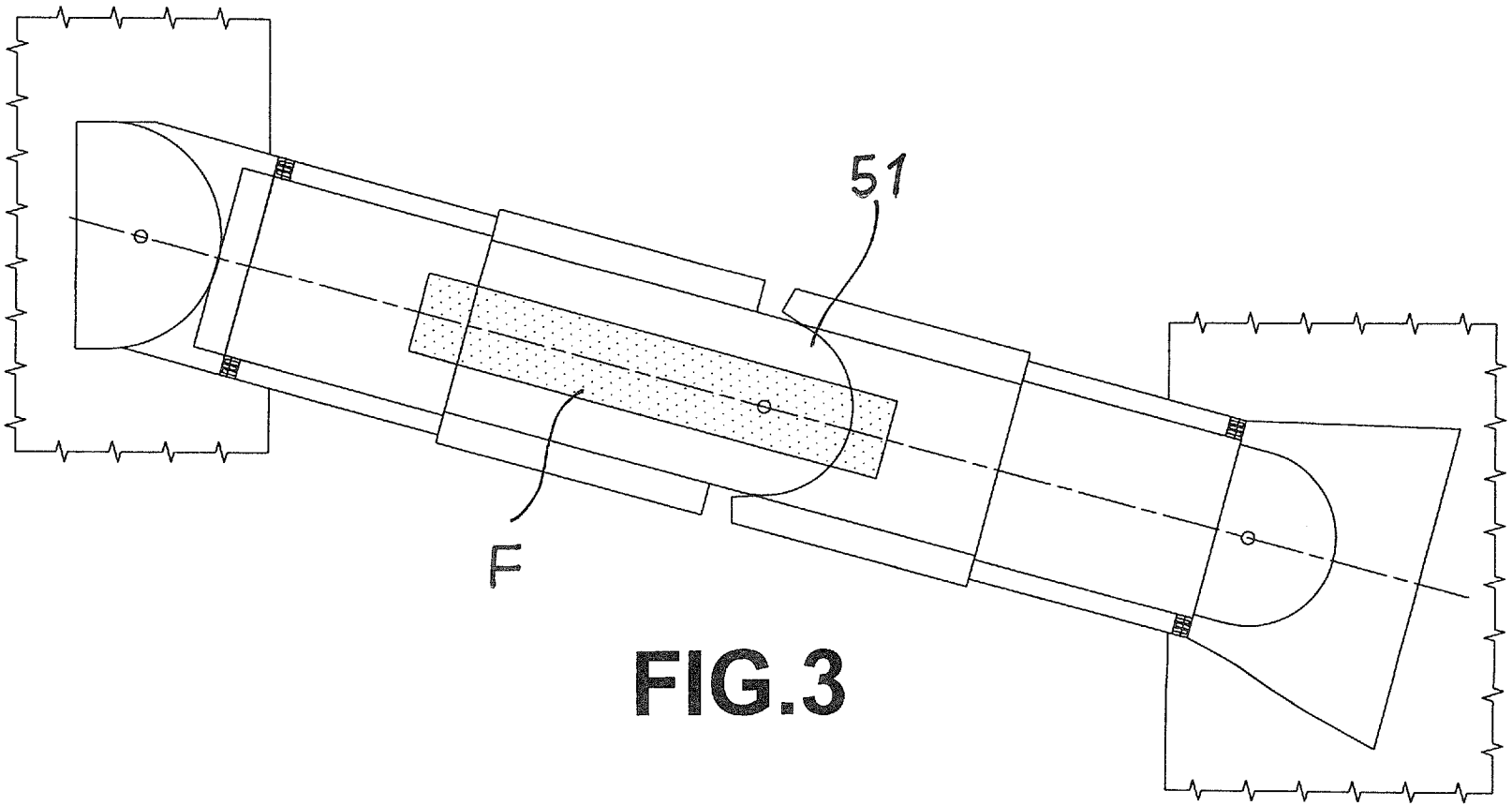
Figure 4:
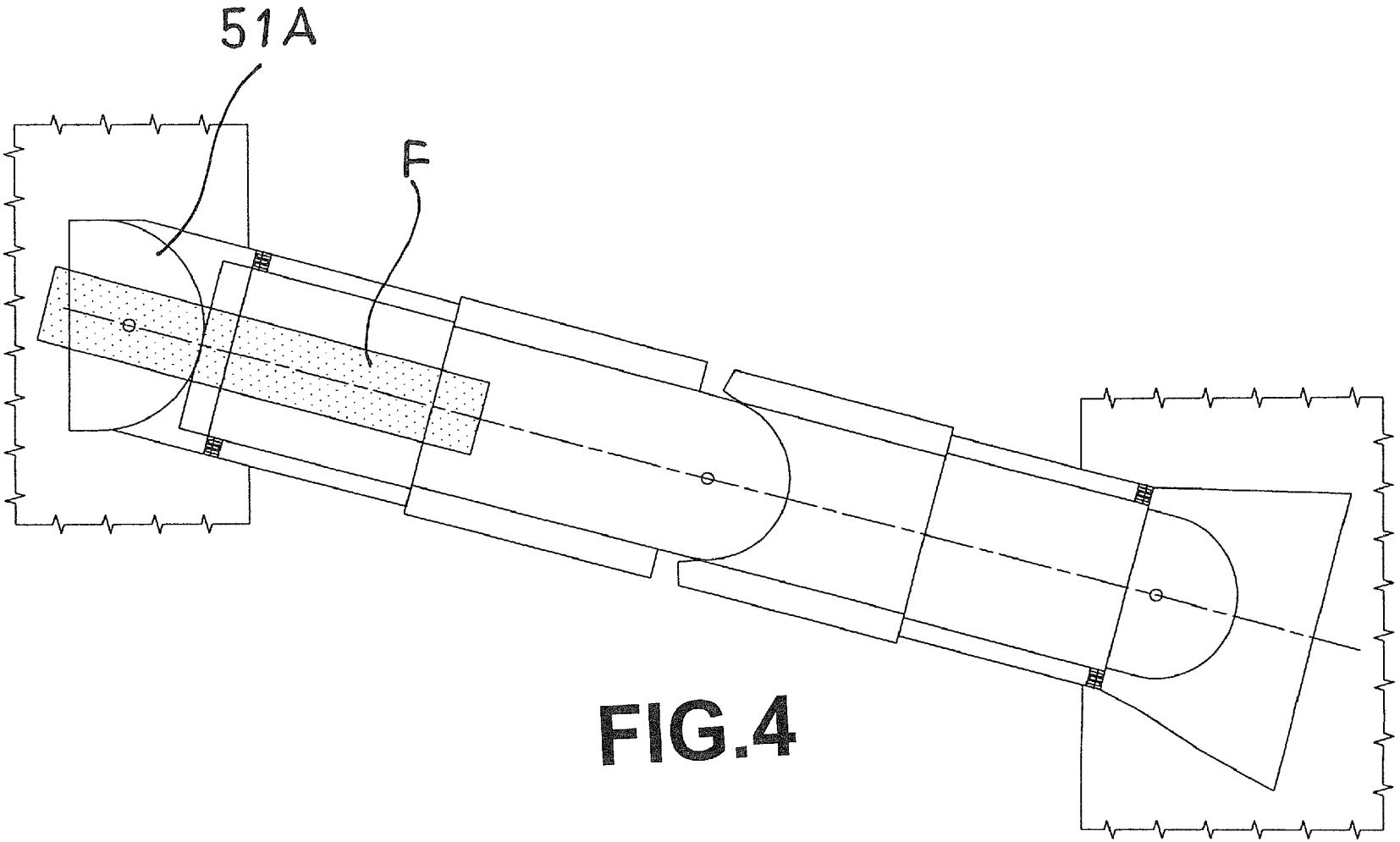

According to the invention, a device 1 for a length-changeable ship ramp 2, which is hoistably pivotably mounted at the end 2A thereof connected to the ship 15 via a pivot joint 150 between a lowered loading and unloading position L and a raised stowing position, has a part 3 of a telescope 4 formed and arranged to form a driveway surface 5 on the ramp 2. A said telescope 4 is formed of co-operating section girders 6, 7 and is formed and arranged to be formed of telescoping section girders 6, 7 extending in the length extension of the ramp parts, square-shaped welded girders or section girders 6, i.e., open or box-shaped section girders, being receivable by girders 7 having an I-shaped cross-section. More precisely, section girders 6 having a rectangular cross-sectional shape, with the long cross-section side 8 lying essentially horizontally, receive the web 9 of the I-shaped girders 7 between themselves.

A middle part 10 of said ramp 2, which comprises at least three ramp parts 10, 11, 12, is formed of a ramp frame having side girders 13, 14 and is hoistably pivotably mounted at the end 2A of the ramp connected to the ship 15 via a pivot joint 150. Said middle part 10 is, with the respective side girders 13, 14 thereof, arranged to guidably receive side hollow sections 16, 17 and 18, 19, respectively, that are situated on the respective ramp end parts 11, 12 or vice versa, i.e., that the side girders 13, 14 of the middle part are receivable in the side hollow sections 16-19.

Vehicles F and other items are moved along the ramp on the upperside thereof, more precisely the driveway surface 5, on the top surface of the ramp parts, but at the portions of the extensible parts meeting each other on a combination of the upwardly facing portions of included section girders, as seen when the ramp 2 is in the lowered loading and unloading position L, in contrast to a conventional raised stowing position not shown. Then vehicles F drive on the upwardly facing respective upperside 6A and upper flange 7A of the arranged section girders 6, 7 when the ramp 2 is in the extended telescopic position. The middle portion of the central ramp part may be formed of conventional sheet-metal plates, etc.

The parts of the different ramp parts 10-12 preferably consist of metal but slide surfaces may be arranged of another suitable material that makes the mutually co-operating parts sliding well in relation to each other but still being strong and durable and resisting mechanical action as well as weathering and also resisting the action of aggressive media, e.g. upon leakage from vehicles F.

Figure 10:
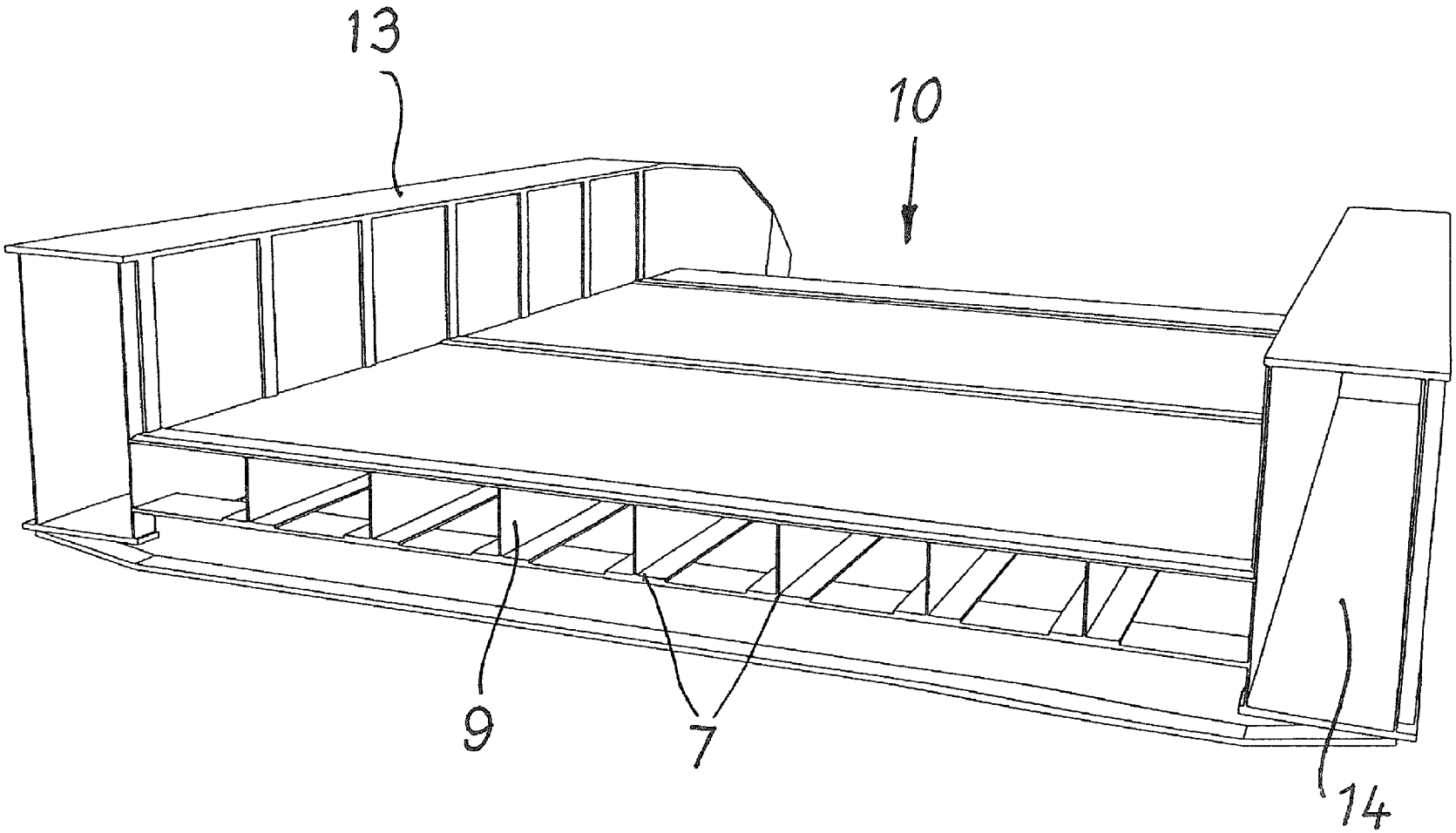
FIG. 10 shows an intermediate part of the ramp as seen obliquely from below.
Figure 10A:
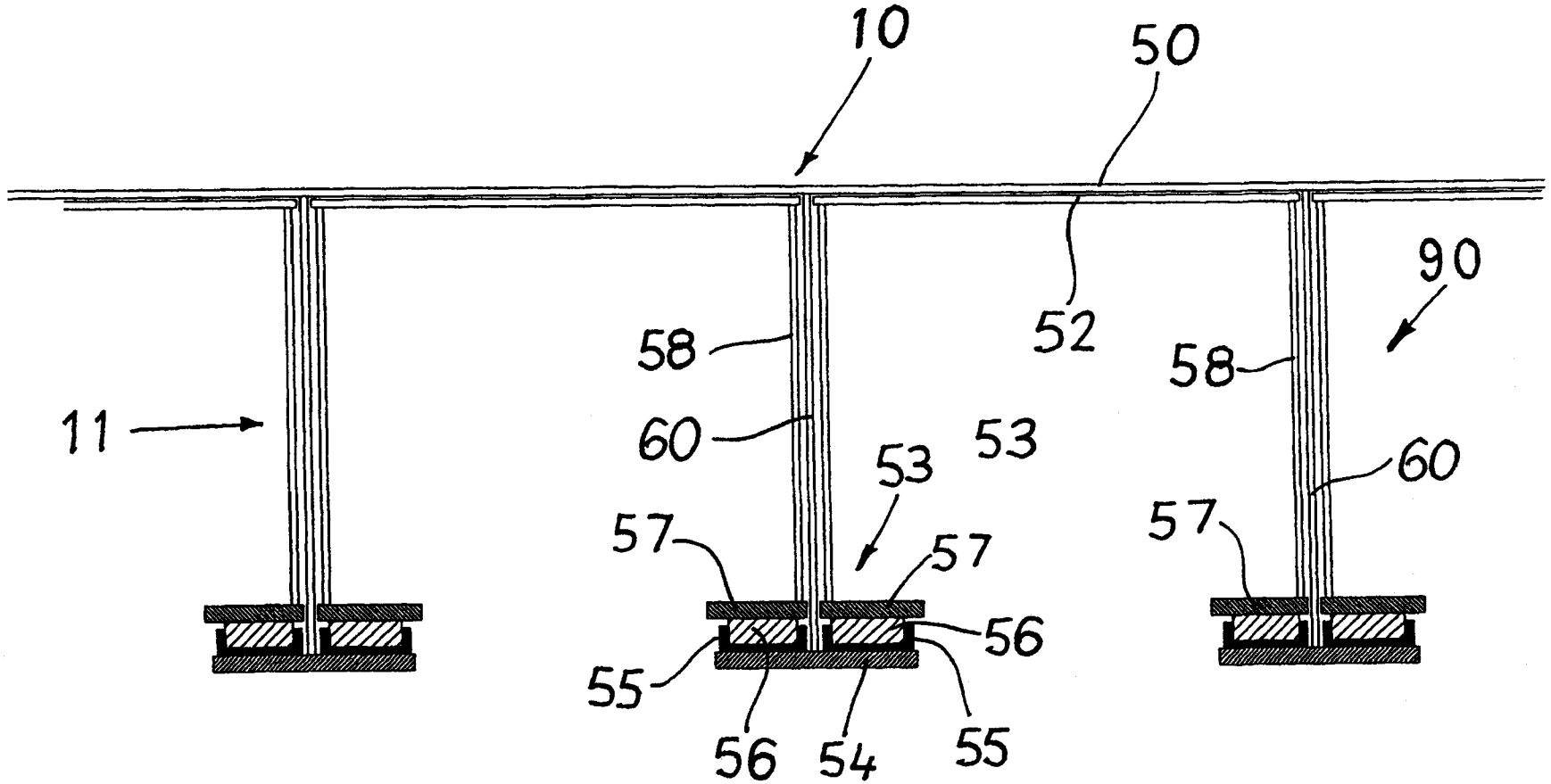
FIG. 10A shows a section view of the ramp with included slide means for the ramp parts in relation to each other.

In FIG. 10A, there is shown an example of the ramp 2 and the included girder parts 10, 11 thereof displaceable in relation to each other in a cross-sectional view. On top, there is the ordinary driveway 50 on the ramp part 10, while internally in hollow spaces 90, there are received downwardly open girders 52 displaceably mounted in the length extension of the ramp parts at the bottom 53 thereof. On a formed foot plate 54 of the middle ramp part 10 carried by the respective web flange 60 of said ramp part, there are suitable holders 55 with plastic material 56 that has good sliding capability and supporting capacity, for instance of the type that is known under the trademark EverEst™, preferably OptiPad. A flange 57 at the lower end of the respective side plate 58 rests on said plastic material, and when said ramp parts 10, 11 move in relation to each other, plastic pads work as a supporting bearing for the driveway ramp part 10. The ramp part 11 receivable internally therein works with the upper girders 52 thereof as driveway upon telescoping in the out position of said ramp parts 10, 11. The corresponding applies to the other pairs of ramps 10, 12 in the opposite direction.

Said pairs of ramps 10, 11 and 10, 12, respectively, resemble a glove with fingers receivable therein, including webs, top plates and flanges of said pairs of ramps 10, 11 and 10, 12, respectively, displaceable in relation to each other.

There are plastics that resist the above-mentioned environments and actions and also different alloys of metals. In order to facilitate displacement of the parts in relation to each other, it is also conceivable to utilize rolling bearings of different kinds suitable therefor. Out at the sides of the ramp, great bending moments are now carried and it is possible to utilize wheels, rolls, slide materials, etc., and the ramp becomes flexible. Dimensions of the ramp 2 may, for instance, be 30-35 m in the longitudinal direction and approx. 5.5 m in the cross direction.

Furthermore, said ship ramp 2 has a device 40 that comprises turntables 51, 51A, 51B, . . . between ramp parts 10, 11, 12, . . . laterally adjustable at a desired turning angle in relation to each other, and/or other parts on board or on the dock.

In that connection, at least two turntables 51, 51A, 51B, . . . are arranged at said telescopic ramp 2 as well as that said turntables are arranged lockable alternately in order of priority. The locking of the turntables 51, 51A, 51B, . . . is arranged to be controllable as, for instance, vehicles F or other cargo items move along the ramp 2 on the top surface thereof. Said locking is arranged to be constructed in such a way that it works so that the turntables 51, 51A, 51B, . . . of the ramp part 10, 11, 12 that the vehicle F, etc., e.g. is positioned on are locked, whereby no pivoting of said turntables 51, 51A and 51B, respectively, can occur in this position, but that the vehicle F, etc., confidently can be driven across the present ramp parts 10, 11; 10, 12 meeting each other and turning of the then intermediate turntable 51, 51A, 51B cannot occur in this position. The locking of the turntables may be effected by means of hydraulics, manually or automatically. The telescopic parts of the ramp 2 are also suitably arranged to be lockable alternately by means known therefor per se to be prevented from telescoping when vehicles F or other movable cargo items are positioned on the ramp part in question. For instance, also by hydraulics, manually or automatically.

Thereby, in case of a telescopic ship ramp 2, vehicles F and other movable cargo items can be driven safely on the ramp 2 between a dock 100 and a ship 15 or between two ships 15, 101 that are moored at dock 100 or are offshore 102 without problems, even if the weather is bad and the sea runs high. In that connection, possible impacts on the ramp 2 from wind and weather are carried by remaining turntables that are not locked and in the arrested state, so that a rigid joint between pair-wise ramp parts is provided precisely when passing said turntables. The turntables 50, 51A, 51B, . . . may be of a known type with circular turning paths of motion having rolling and/or sliding bearings between the parts therein movable in relation to each other and may consist of a suitable material that resists wind and weather as well as heavy workloads. They extend normally in the horizontal direction and along a common plane when the entire ramp 2 is arranged in a horizontal lowered position and then have essentially vertical turning axes 20, 21, 22 around which pair-wise ramp parts or other parts turn in relation to each other.

Figure 5:
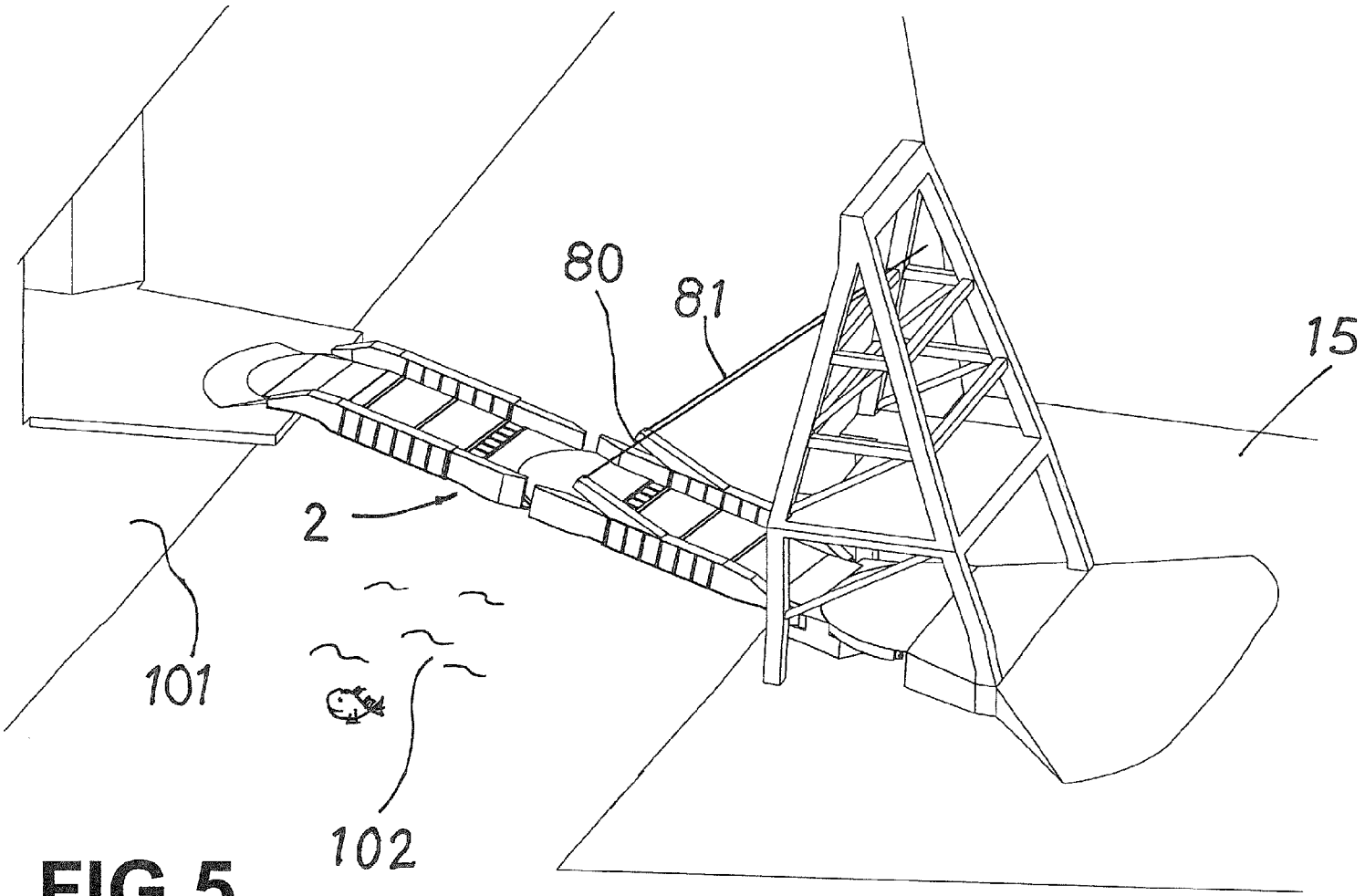
FIG. 5 shows the ramp in operation between ships.
Figure 6:
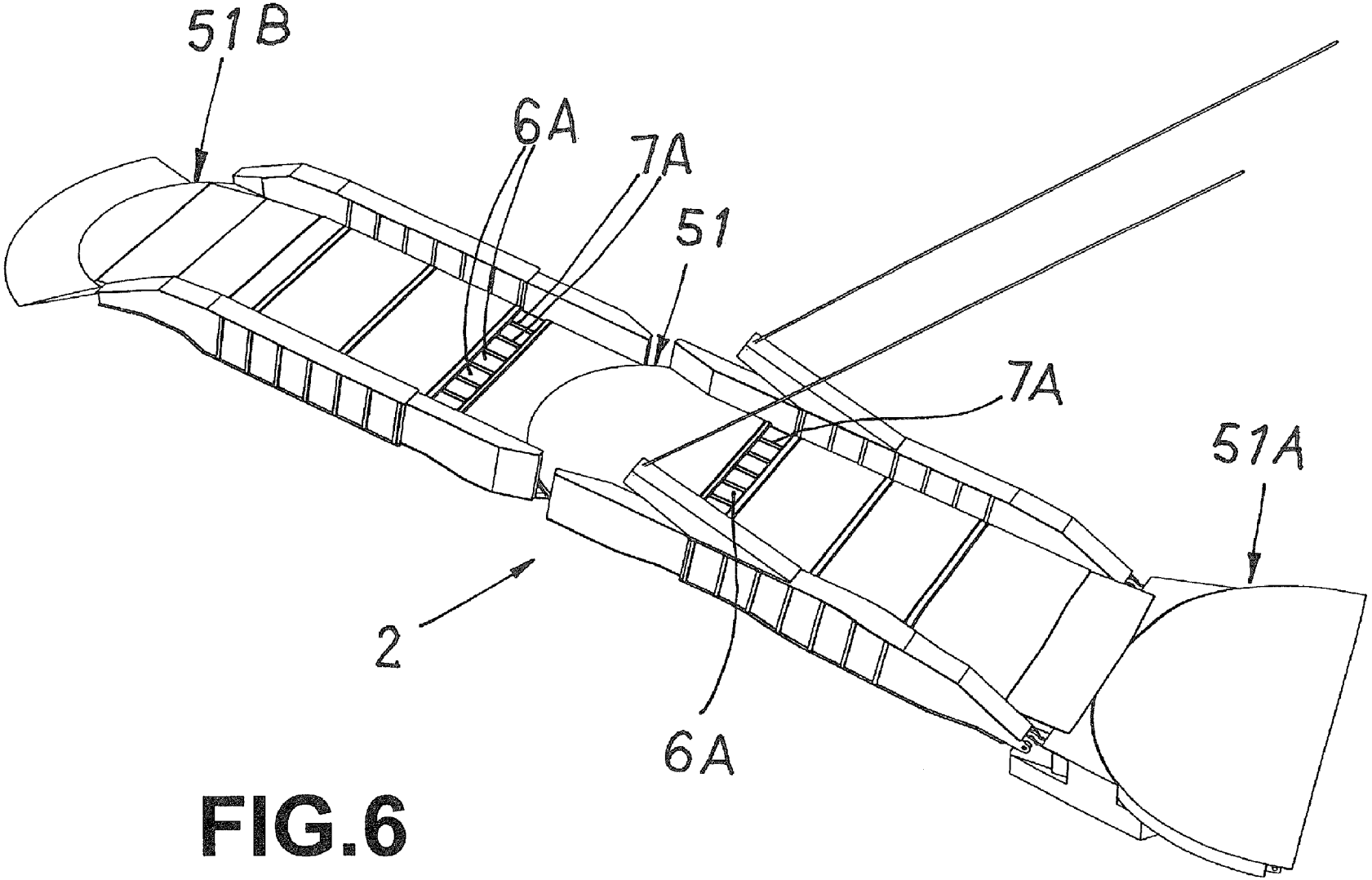
FIGS. 6-7 show perspective views of the ramp obliquely from above and obliquely from below, respectively, in the lowered driving position.
Figure 7:
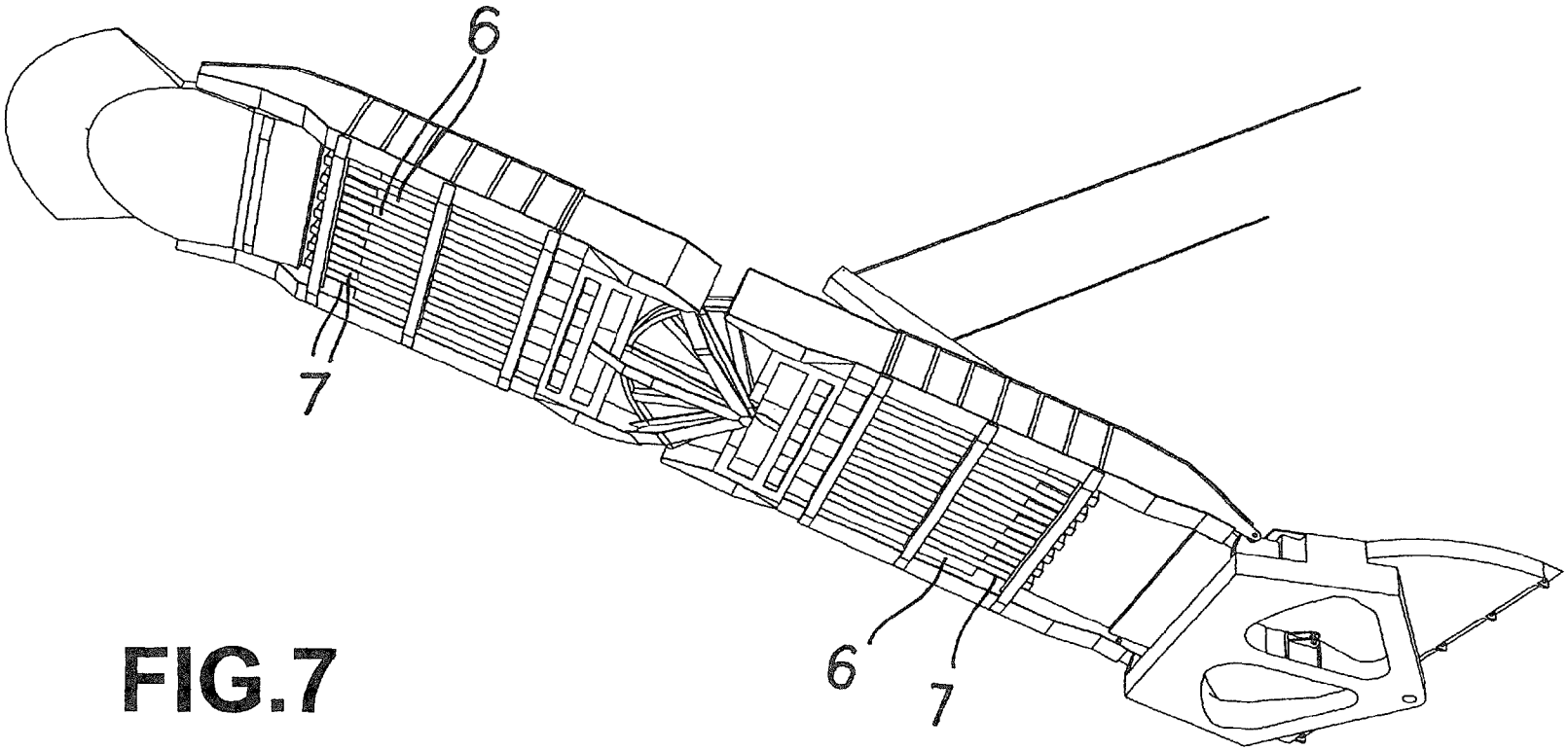
Figure 8:
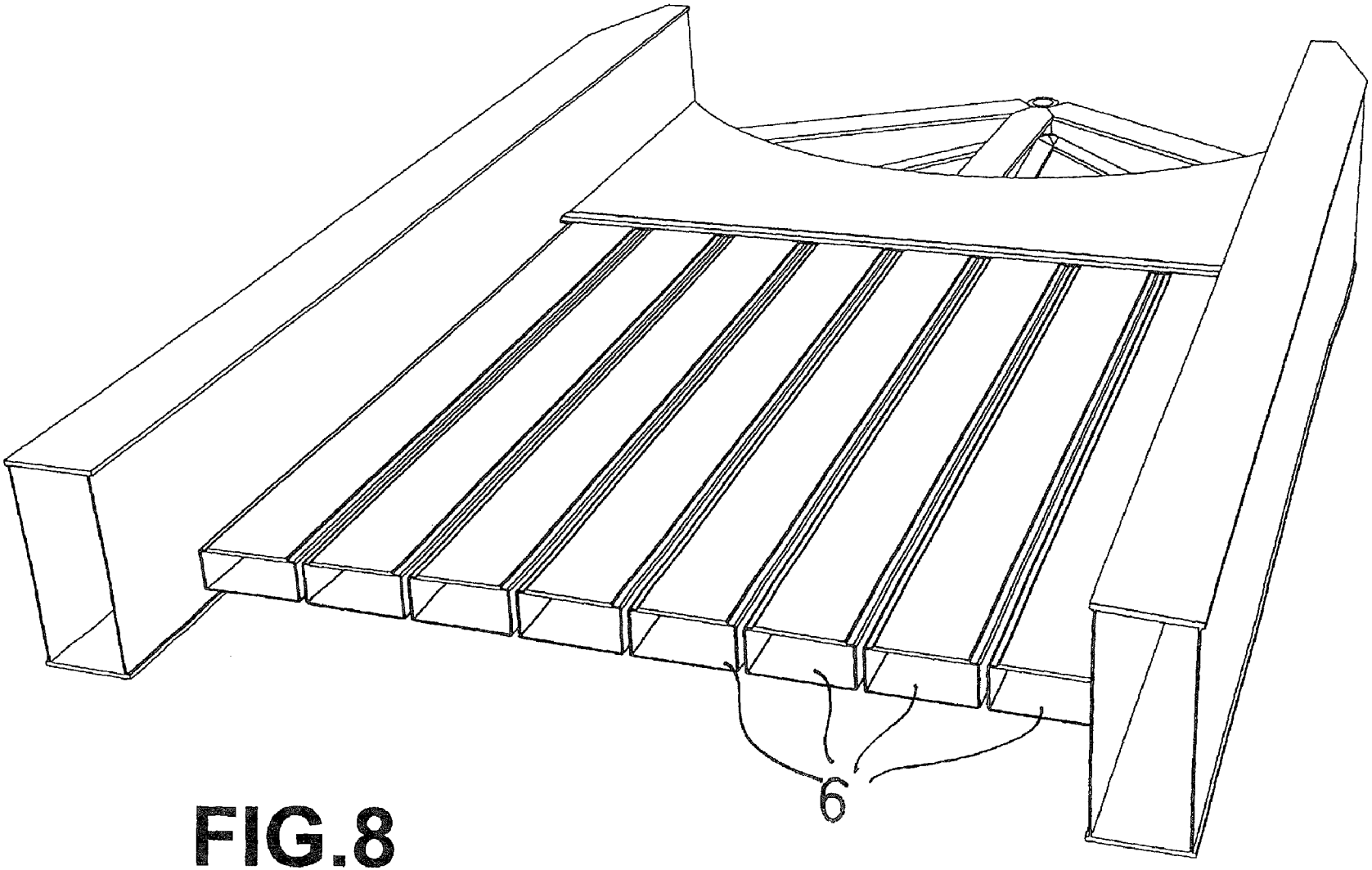
FIGS. 8-9 show an end part of the ramp as seen obliquely from above and obliquely from below, respectively.
Figure 9:
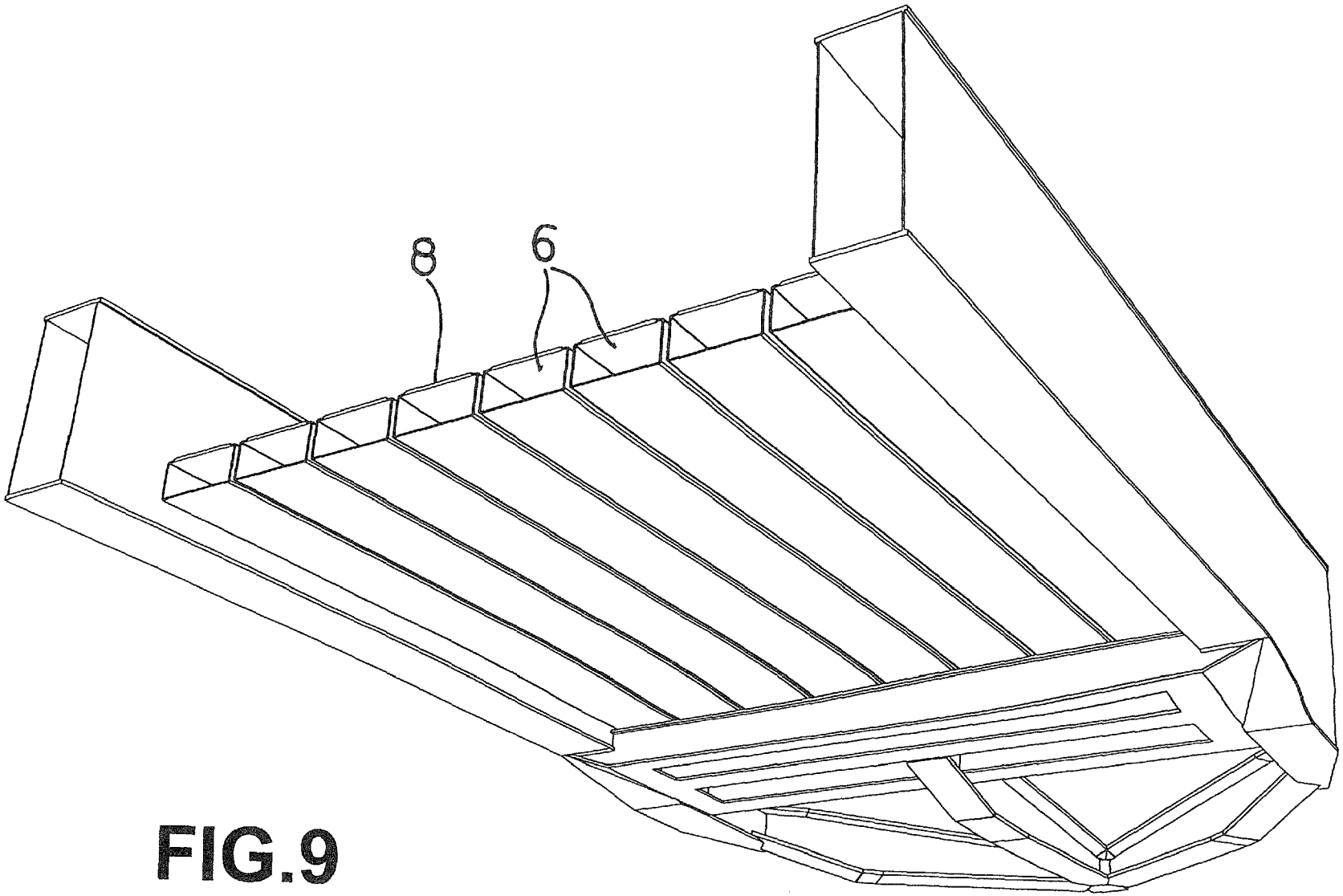

In order to simplify wire running and other annoying and price-rising arrangements for the actuation of a said, ramp 2, a central ramp telescopic part 10 is pivotably liftable by means of only one lifting wire 75 arranged. Said lifting wire 75 is, in a known way, windable on a motor-driven winding drum 76, but outgoing free ends 75A of the lifting wire 75 are connected to a fastening part 77 that preferably is situated at the centre of said turnable ramp middle part. In the drawings, said fastening part 77 is formed of a fastening bow above the ramp 2, but may also be another suitable construction. Also conventional hoisting by means of wires 80, 81 in pairs, as is shown in FIGS. 5-7, is naturally possible, particularly if it is wanted not to limit the vehicle height of the ramp 2.

Figure 11:
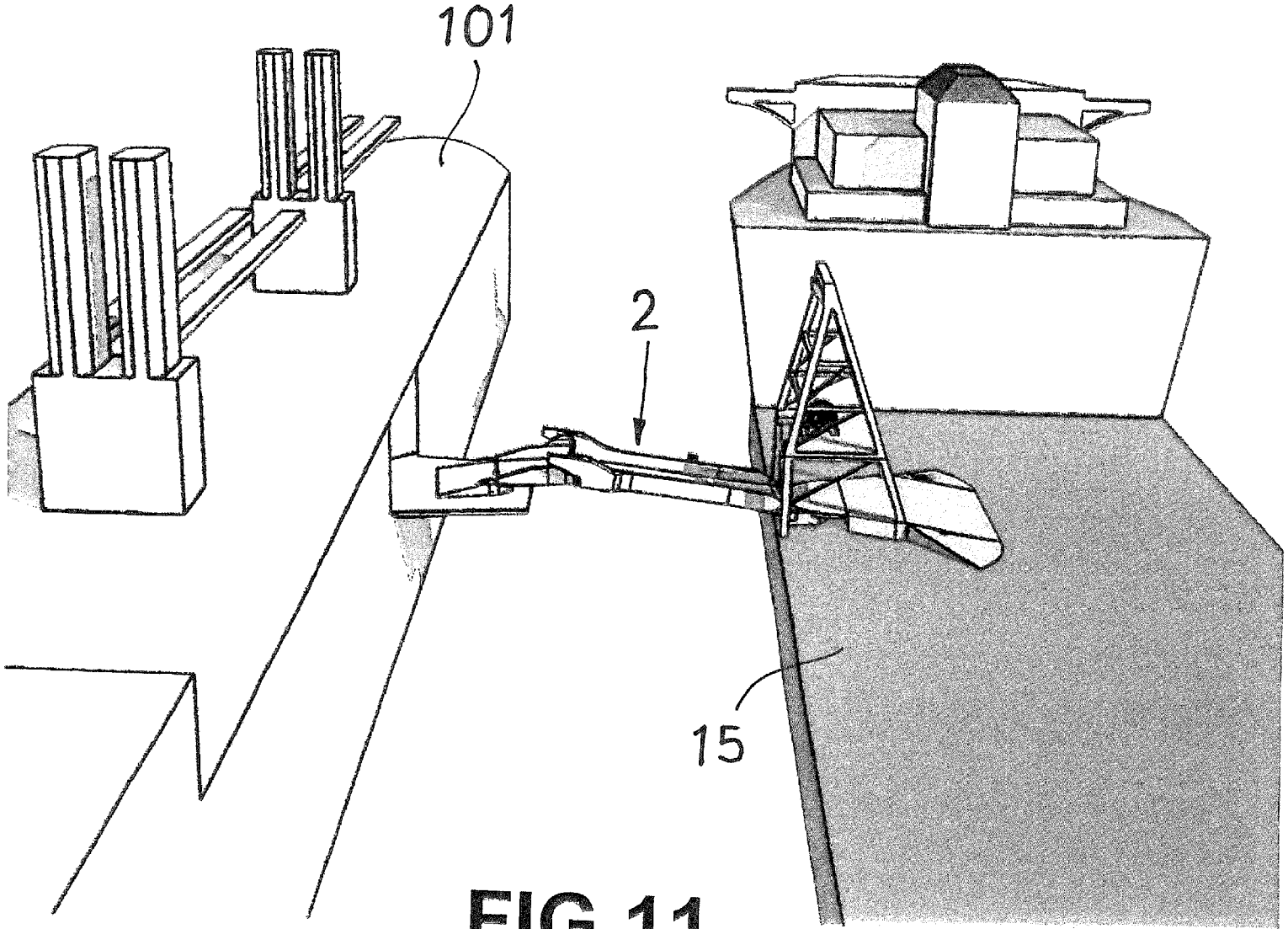
FIGS. 11-12 show variants of the ramp in operation between ships.
Figure 11A:
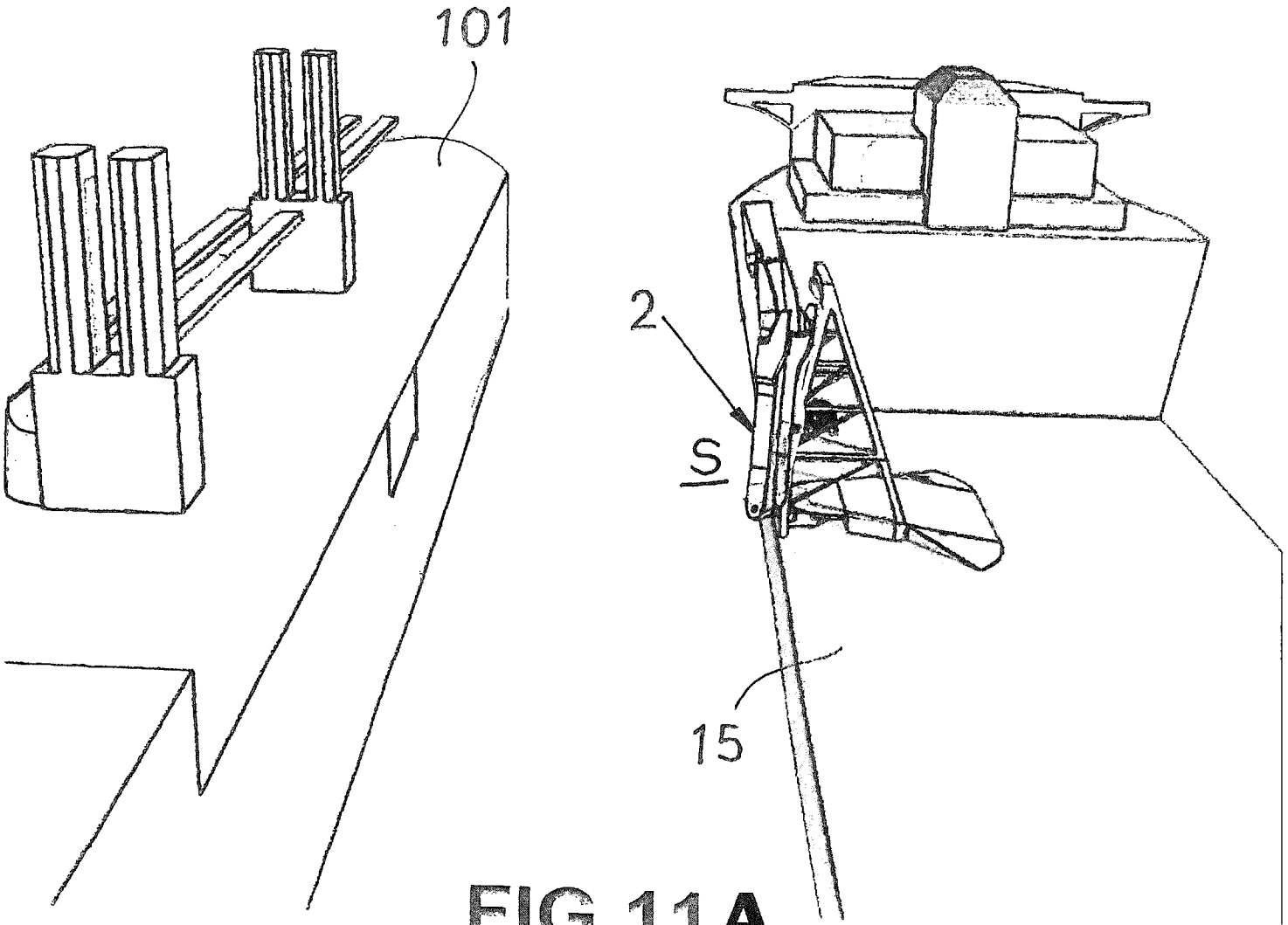
FIG. 11A shows the ramp in the folded-in raised stowing position.
Figure 12:
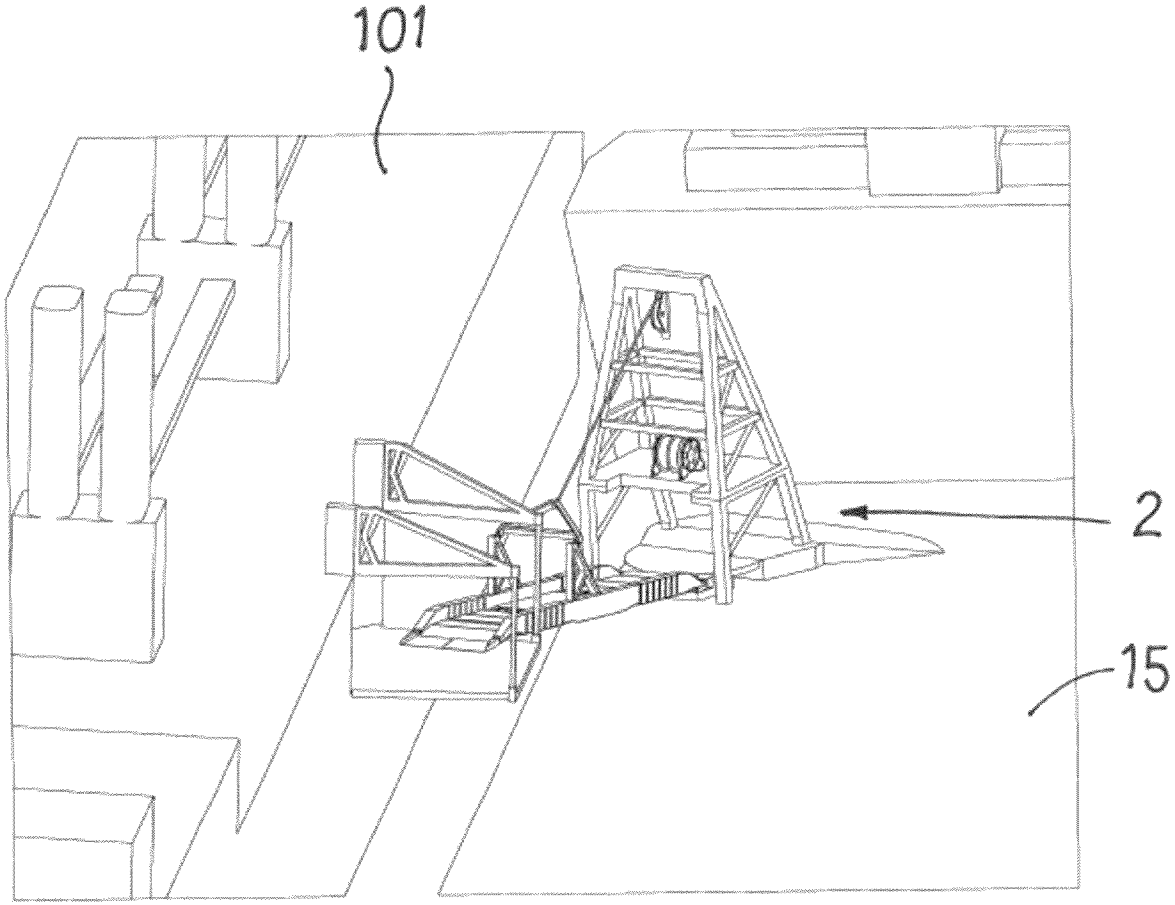
Figure 13:
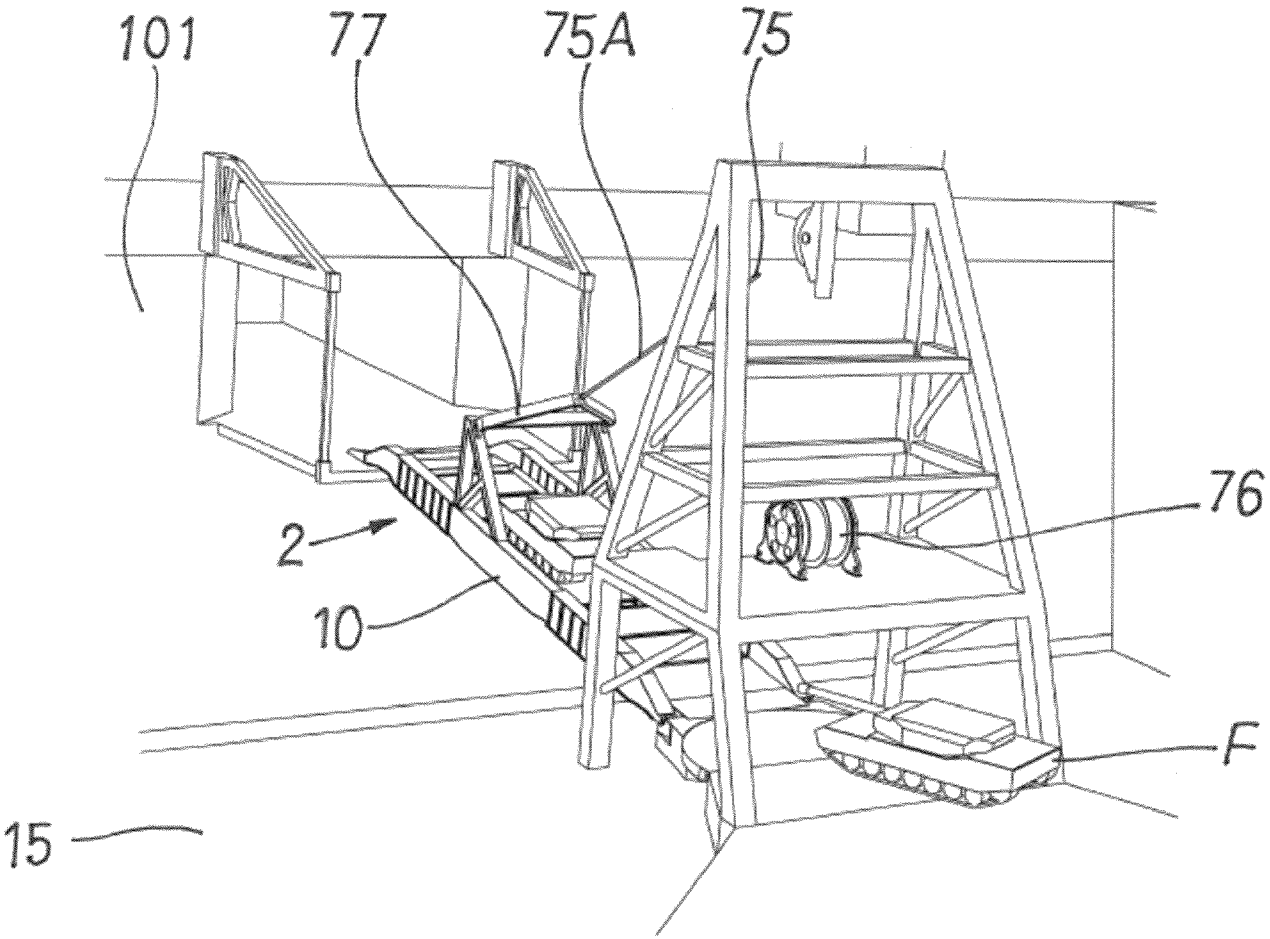
FIGS. 13-16 show the ramp in the operative position where vehicles are transported from one ship to the other.
Figure 14:
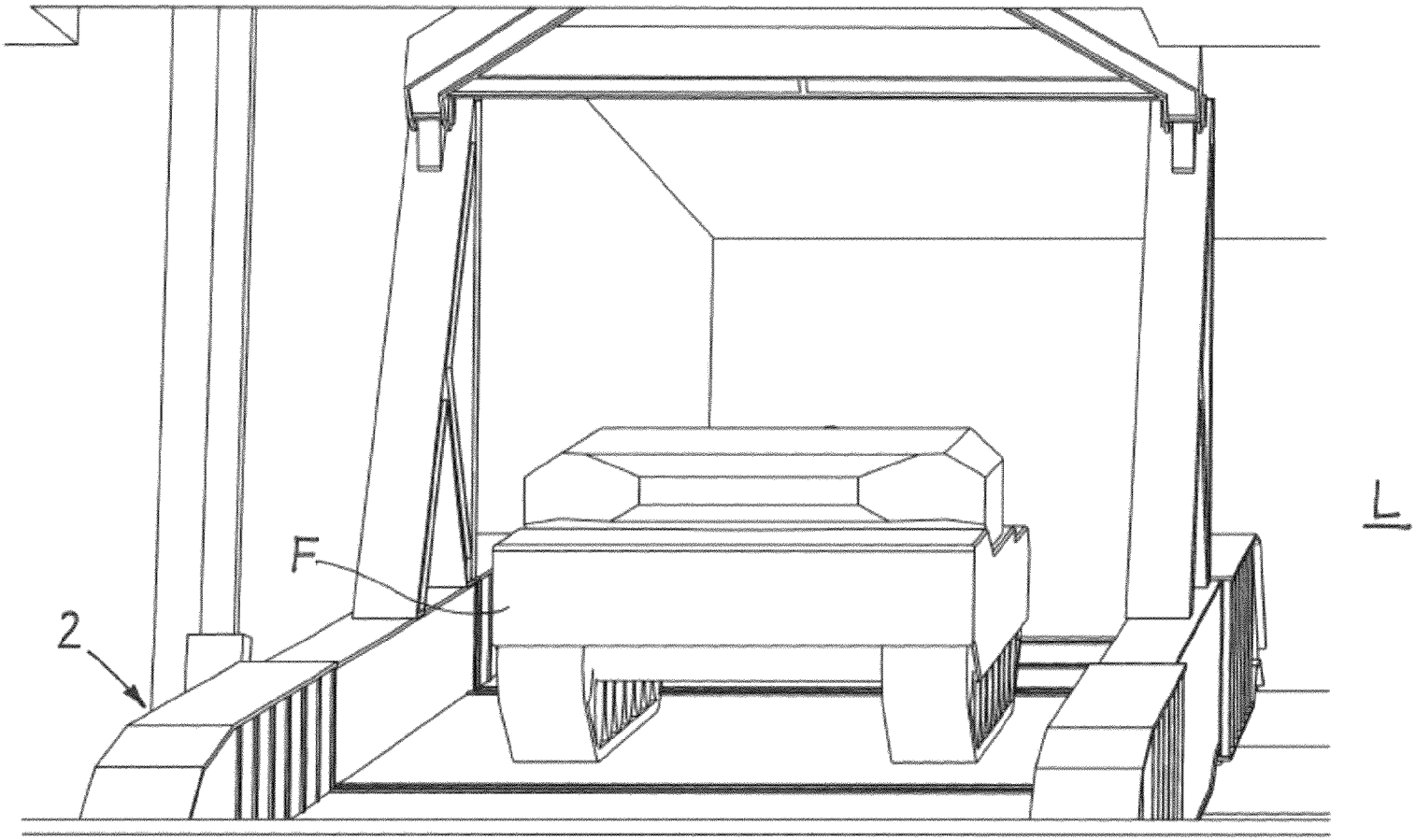
Figure 15:
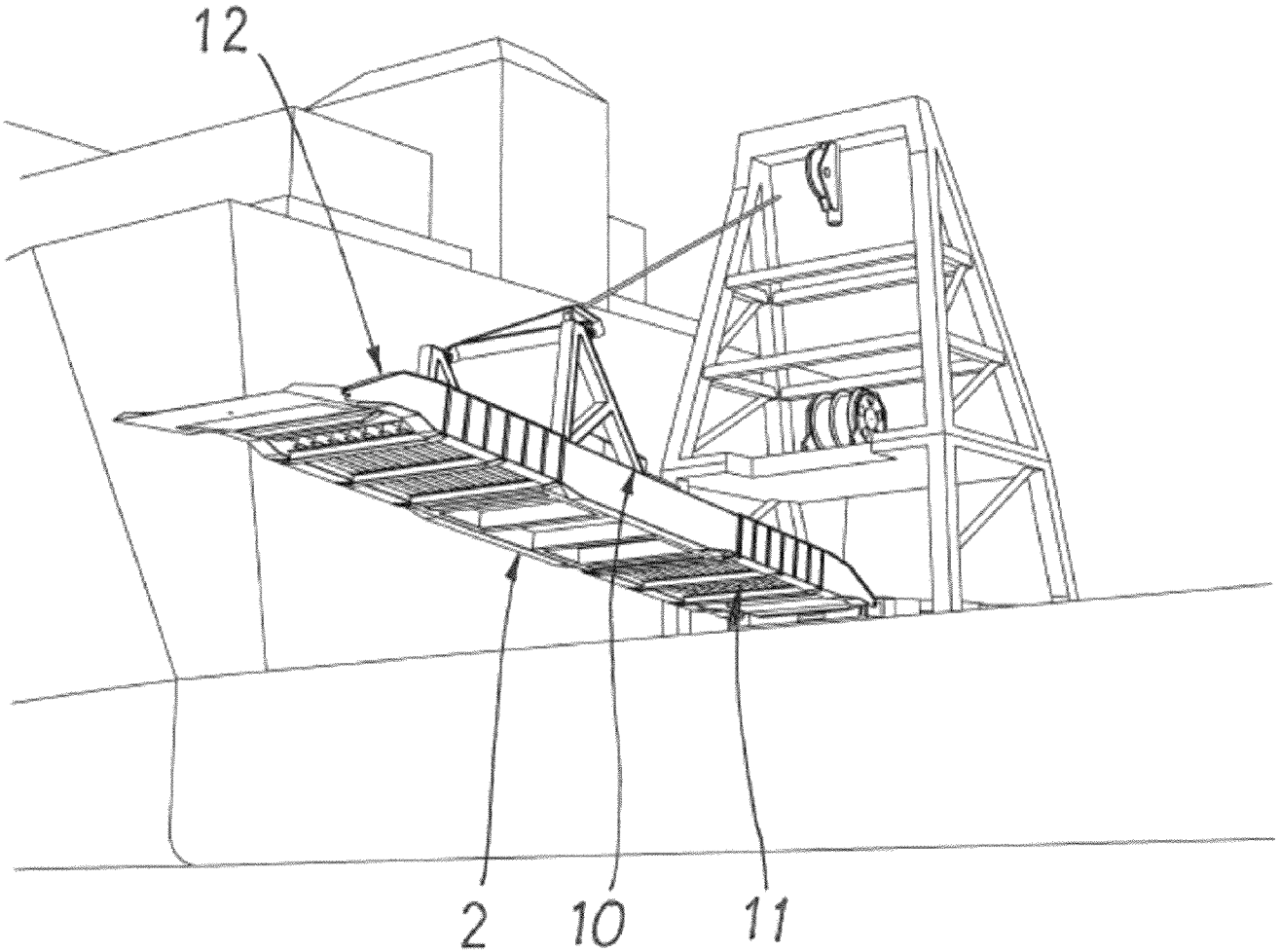
Figure 16:
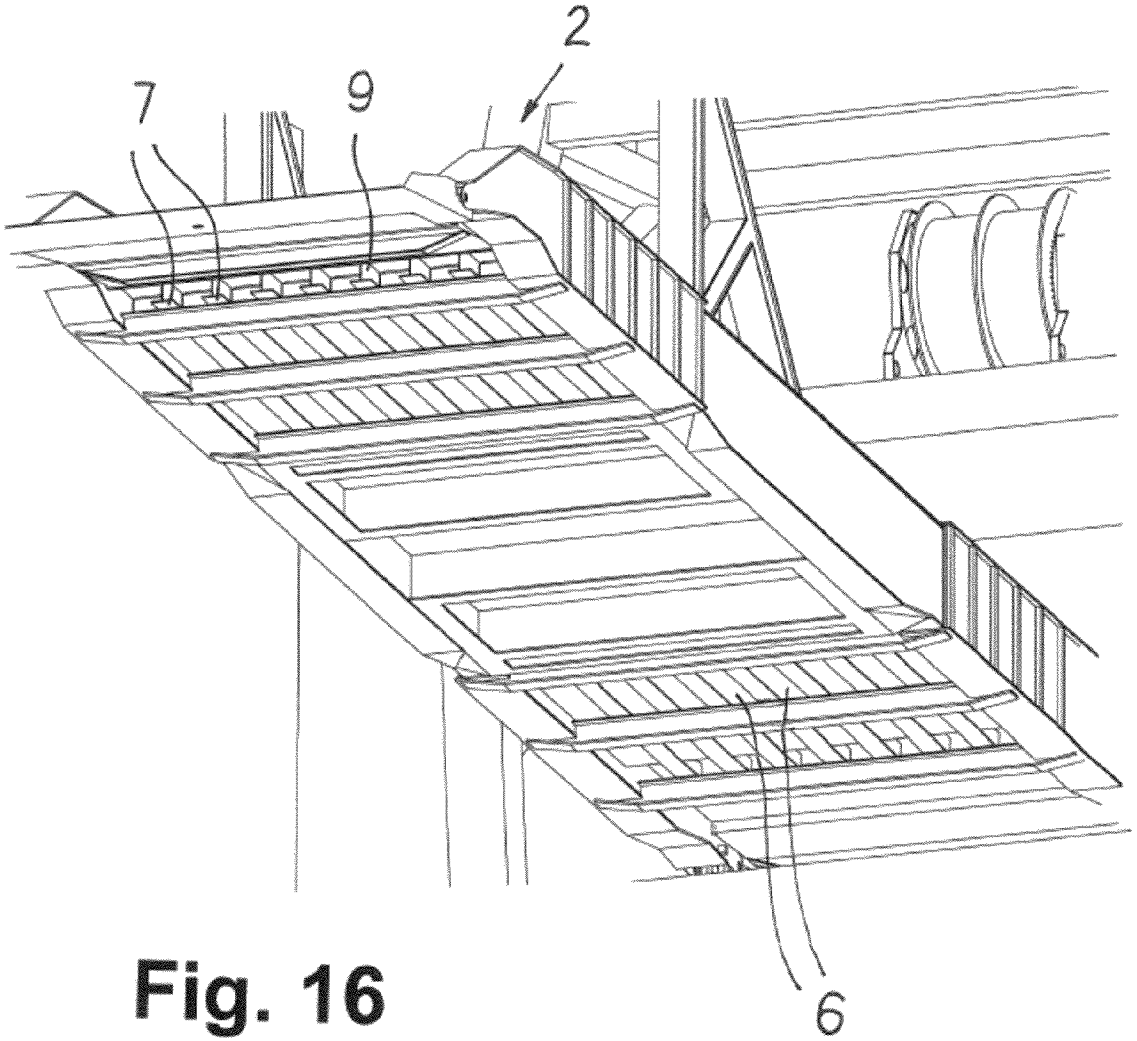

A said ramp 2 with included parts according to the invention may be situated on a suitable place on board a ship. In the drawings in FIGS. 11 and 12, there are shown suggestions of a laterally mounted ramp having a pivoting direction alternatively mounted transversely or essentially longitudinally along the ship, but it may naturally be mounted at any place and with any direction on board.

The function and nature should have been understood from what has been indicated above and shown in the drawings.

Naturally, the invention is not limited to the embodiments described above and shown in the accompanying drawings. Modifications are feasible, particularly as for the nature of the different parts, or by using an equivalent technique, without departing from the protection area of the invention, such as it is defined in the claims.

What is claimed is:

1. A length-changeable telescopic ship ramp hoistable by a lifting wire, comprising:

a pivot joint at an end of the ramp connected to the ship for moving the ramp between a lowered position and an raised position, the lowered position being for loading and unloading the ship and the raised position being for stowing the ramp;

turntables between end parts of the ramp or between an end part of the ship and an end part of the ramp, the turntables being adjustable to desired turning angles in relation to one another; and a telescope of telescoping, co-operating open or box-shaped section girders extending in a length direction of the ramp, wherein square-shaped section girders are configured to be received by girders having I-shaped cross-sections and have rectangular cross-sections that have a long cross-section side that is substantially horizontal, the square-shaped section girders receiving a web of the girders having I-shaped cross-sections between each other such that a driveway is formed on upwardly facing sides of the square-shaped girders and upper flanges of the girders having I-shaped cross-sections.

2. The ship ramp of claim 1, wherein the turntables are independently lockable, and the telescoping section girders extend in the length direction of the ramp and the driveway surface.

3. The ship ramp of claim 2, wherein locking the turntables is controllable to avoid pivoting of the turntables.

4. The ship ramp of claim 3, wherein the telescope is configured to be locked to avoid telescoping of the telescope.

5. The ship ramp of claim 1, further comprising side girders extending at least in a common direction.

6. The ship ramp of claim 5, wherein the turntables are independently lockable, and the telescoping section girders extend in the length direction of the ramp and the driveway surface.

7. The ship ramp of claim 6, wherein locking the turntables is controllable to avoid pivoting of the turntables.

8. The ship ramp of claim 7, wherein the telescope is configured to be locked to avoid telescoping of the telescope.

9. The ship ramp of claim 5, wherein side girders of a middle part of the ramp extend in pairs in a direction from each other at respective ends of the middle part, and the side girders are telescoping.

10. The ship ramp of claim 9, wherein the turntables are independently lockable, and the telescoping section girders extend in the length direction of the ramp and the driveway surface.

11. The ship ramp of claim 10, wherein locking the turntables is controllable to avoid pivoting of the turntables.

12. The ship ramp of claim 11, wherein the telescope is configured to be locked to avoid telescoping of the telescope.

* * * * *